US006404345B1

(12) United States Patent
Frasier

(10) Patent No.: US 6,404,345 B1
(45) Date of Patent: Jun. 11, 2002

(54) ELECTRICAL SYSTEM

(76) Inventor: Berwyn Travis Frasier, 2325 Country Club Rd., Sparta, TN (US) 38583

( * ) Notice: Subject to any disclaimer, the term of this patent is extended or adjusted under 35 U.S.C. 154(b) by 48 days.

(21) Appl. No.: 09/660,780

(22) Filed: Sep. 13, 2000

(51) Int. Cl.[7] ..... G08B 21/00

(52) U.S. Cl. ..... 340/626; 340/605; 340/606; 73/42.5 R; 137/551

(58) Field of Search ..... 347/605, 606, 347/626, 607, 618; 73/40, 42.5 R; 137/80, 551, 557, 558

(56) References Cited

U.S. PATENT DOCUMENTS 3,846,774 A * 11/1974 Thorbard et al. ..... 340/611
4,106,002 A * 8/1978 Hogue, Jr. ..... 340/626
4,742,841 A * 5/1988 Vonderhaar et al. ... 137/115.21
4,845,472 A * 7/1989 Gordon et al. ..... 340/605
4,977,923 A * 12/1990 Cho ..... 137/414
5,139,044 A * 8/1992 Otten et al. ..... 137/80
5,153,564 A * 10/1992 Hoiberg ..... 340/604
5,190,069 A * 3/1993 Richards ..... 137/312
5,240,022 A * 8/1993 Franklin ..... 137/1
5,240,028 A * 8/1993 Hoch, Jr. et al. ..... 137/80
5,377,529 A * 1/1995 Boyd ..... 73/40
5,539,384 A * 7/1996 Frasier ..... 340/605

* cited by examiner

*Primary Examiner*—Edward Lefkowitz

(57) ABSTRACT

An electronic system with a control box. Pressure sensors are coupled to the electrical lines to determine and display pressure. Flow metering devices are coupled to the electrical ines to determine and display the flow rate. Liquid bridging sensors include four liquid bridging sensors in four sites with a valve actuated by electro-mechanical means. The valve located within the water line with a voice-auto dialer allowing data from the system to be transferred via a phone line. An electrical circuit includes a port for coupling with a conventional central computer and has computing software allowing the storing of the rate of flow of water. An internet program is adapted to notify the user and authorities upon emergency shut-off and provide the pressure and flow rates of the water lines and if the liquid bridging sensors have detected leaks. Finally included is control software to program and shut off the water supply.

7 Claims, 3 Drawing Sheets

ELECTRICAL SYSTEM

BACKGROUND OF THE INVENTION

1. Field of the Invention

The present invention relates to an electronic system and more particularly pertains to controlling and monitoring water lines.

2. Description of the Prior Art

The use of water control devises of various designs and configurations is known in the prior art. More specifically, water control devices of various designs and configurations previously devised and utilized for the purpose of precluding the flow of water through a house when desired parameters are not meet through various methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,742,841 to Vonderhaar et al., discloses a water shut-off valve. U.S. Pat. No. 4,845,472 to Gordon discloses a leak sensing alarm and supply shut-off apparatus. U.S. Pat. No. 4,977,923 to Cho discloses a pilot-controlled water pressure-operated diaphragm shut-off valve. Lastly, U.S. Pat. No. 5,153,564 to Hoch, Jr., et al., discloses a temperature sensitive water supply shut-off.

While these devices fulfill their respective, particular objectives and requirements, the aforementioned patents do not describe electronic system that allows controlling and monitoring water lines.

In this respect, the electrical system according to the present invention substantially departs from the conventional concepts and designs of the prior art, and in doing so provides an apparatus primarily developed for the purpose of controlling and monitoring water lines.

Therefore, it can be appreciated that there exists a continuing need for a new and improved which can be used for controlling and monitoring water lines. In this regard, the present invention substantially fulfills this need.

SUMMARY OF THE INVENTION

In view of the foregoing disadvantages inherent in the known types of water control devices of various designs and configurations now present in the prior art, the present invention provides an improved electrical system. As such, the general purpose of the present invention, which will be described subsequently in greater detail, is to provide a new and improved electrical system and method which has all the advantages of the prior art and none of the disadvantages.

To attain this, the present invention essentially comprises a new and improved electronic system for controlling and monitoring water lines, comprising more specifically, the central component of the system is a control box. Such control box is for operating the system in an intended manner. It is preferably positioned within the house of the user. A digital light emitting diode display is mounted to the control box. The display indicates a numerical value indicative of a sensed water pressure and a rate of flow of water. Also a buzzer is mounted in the control box. It functions to generate an audible signal upon the pressure flow or liquid bridging being identified outside of a high or low acceptable range. Ideally, a remote security alarm service is connected with the buzzer. As such, the present invention may be monitored form afar. The remote security alarm is preferably connected via a phone line and is adapted to notify authorities upon the pressure flow or liquid bridging being identified as being outside an acceptable range of parameters. Extending downwardly from the control box is a first electrical line. Such electrical lines extends from the control box to a source of potential within the house. The source of potential ideally comprises of a standard AC source in combination with a DC battery backup. Next provided is a plurality of second electrical lines from the control box to a plurality of water lines for the house to sensed for changes and pressure. Next provided is a third electrical line from the control box to a telephone line. Another electrical circuit within the control box allowing the system to accept both AC and DC power. This outside transformer power supply, A/C to D/C, may be used to reduce the cost of the overall system. A plurality of pressure sensors are coupled with respect to the second electrical lines to determine the pressure within the water line. These pressure sensors are also couple the display to indicate such determined pressure. FIG. 5 show three pressure metering devices including a first pressure metering device in a first location, a second pressure metering device in a second location and a third pressure sensor in a third location. However the present invention is not limited by this number. Further provided is a plurality of flow metering devices. These flow metering devices are coupled with respect to the second electrical lines. Their function is to determine the rate of flow of the water within the water line and to allow the display to indicate such determined rate of flow of the water. FIG. 5 shows three such flow metering devices including a first flow metering device in the first location, a second flow metering device in the second location and a third flow metering device in the third location. However the present invention is not limited to this number. Also provided are a plurality of liquid bridging sensors. FIG. 5 show four such devices including a first liquid bridging sensor in a first site, a second liquid bridging sensor in a second site, a third liquid bridging sensor in a third site and fourth bridging sensor in a fourth site. All the liquid bridging sensor are mounted to the second electrical lines to detect leak outside of the pipes. However the present invention is not limited to this number. Next included is a valve actuated by electro-mechanical means. The valve is located within the water line at the first location and mounted thereto adjacent to the pressure sensor and flow sensor in a fashion similar to that of an existing main control valve. The valve is adapted to shut off the flow of water automatically upon the pressure flow or liquid bridging being outside of the acceptable high or low range for a predetermined amount of time. The valve is further adapted to shut off the flow of water manually from the control box or other source at the discretion of a user upon the inspection of the display on the control box or remote location. A voice-auto dialer is included in the control box and coupled to the third electrical allowing data from the system to be transferred via a phone line. The voice auto-dialer may be incorporated to notify the user or authorities upon emergency water shut-off and the time thereof, via phone jack. An existing alarm system is coupled to the system to notify users and authorities. An electrical circuit included in the control box includes a port for allowing coupling with a conventional central computer. Also provided is computing software adapted to be loaded on the central computer. This computing software allows the storing of the rate of flow of water and further calculating the amount of water consumed over a predetermined amount of time and the price of water consumed.

Further provided is an internet program loaded on to the central computer adapted to notify the user and authorities upon emergency shut-off and status of the water lines including the pressure and flow rate. Lastly provided is control software loaded on the computer to program and is adapted to shut-off the water supply utilizing the central computer or a remote source via the internet. Multiple pressure sensors, flow sensors and liquid bridging sensors may be connected to the control box to form a safety network to detect leaks, outside or inside of a building on any water supply pipe in any area inside or outside of the building. The user may be able to program and shut-off the water supply via computer software program from the main or remote source. Also, optionally, the computer software may interface with the main control box to detect a leak and utilize an existing internet software program to notify the user or authorities upon emergency water shut off the time thereof. Also, unillustrated switches may be utilized to program the values, high or low, of the pressure or flow of water so the user can predetermine the range of an acceptable water shut off time. This allows leaky faucets, toilets and appliances to still operate without premature water shut-off. Also unillustrated switches may be immediately utilized to program the on or off flow of water for an extended period of time within a day, week or month if needed to allow for maintenance inside or outside of the building when the user is home or away.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved electrical system which has all of the advantages of the prior art water control devices of various designs and configurations and none of the disadvantages.

It is another object of the present invention to provide a new and improved electrical system which may be easily and efficiently manufactured and marketed.

It is further object of the present invention to provide a new and improved electrical system which is of durable and reliable constructions.

An even further object of the present invention is to provide a new and improved electrical system which is susceptible of a low cost of manufacture with regard to both materials and labor, and which accordingly is then susceptible of low prices of sale to the consuming public, thereby making such electrical system economically available to the buying public.

Even still another object of the present invention is to provide a electrical system for controlling and monitoring water lines.

Lastly, it is an object of the present invention to provide a new and improved electrical circuit including a port for coupling with a conventional central computer and has computing software allowing the storing of the rate of flow of water. An internet program is adapted to notify the user and authorities upon emergency shut-off and provide the pressure and flow rates of the water lines and if the liquid bridging sensors have detected leaks. Finally included is control software to program and shut off the water supply.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
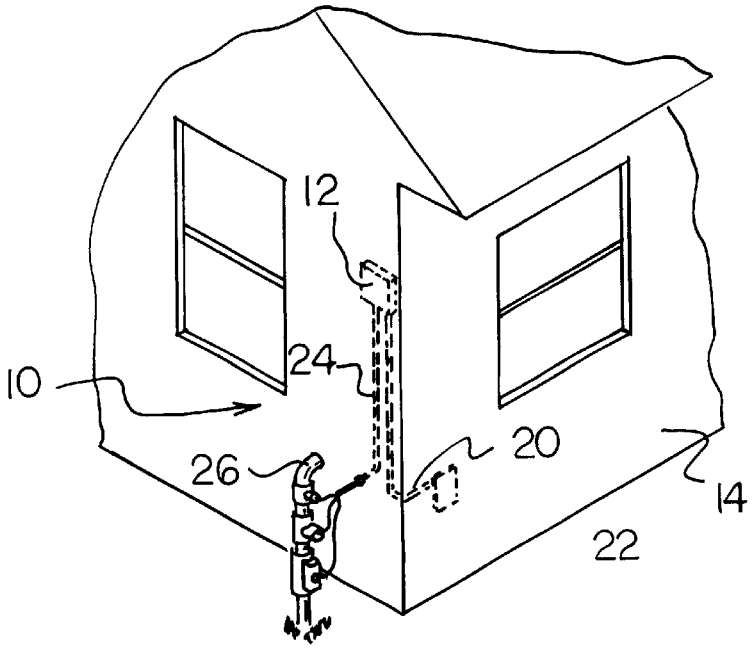
FIG. 1 is a perspective illustration of the exterior of a house equipped with the preferred embodiment of the electronic system for controlling and monitoring water lines.
Figure 2:
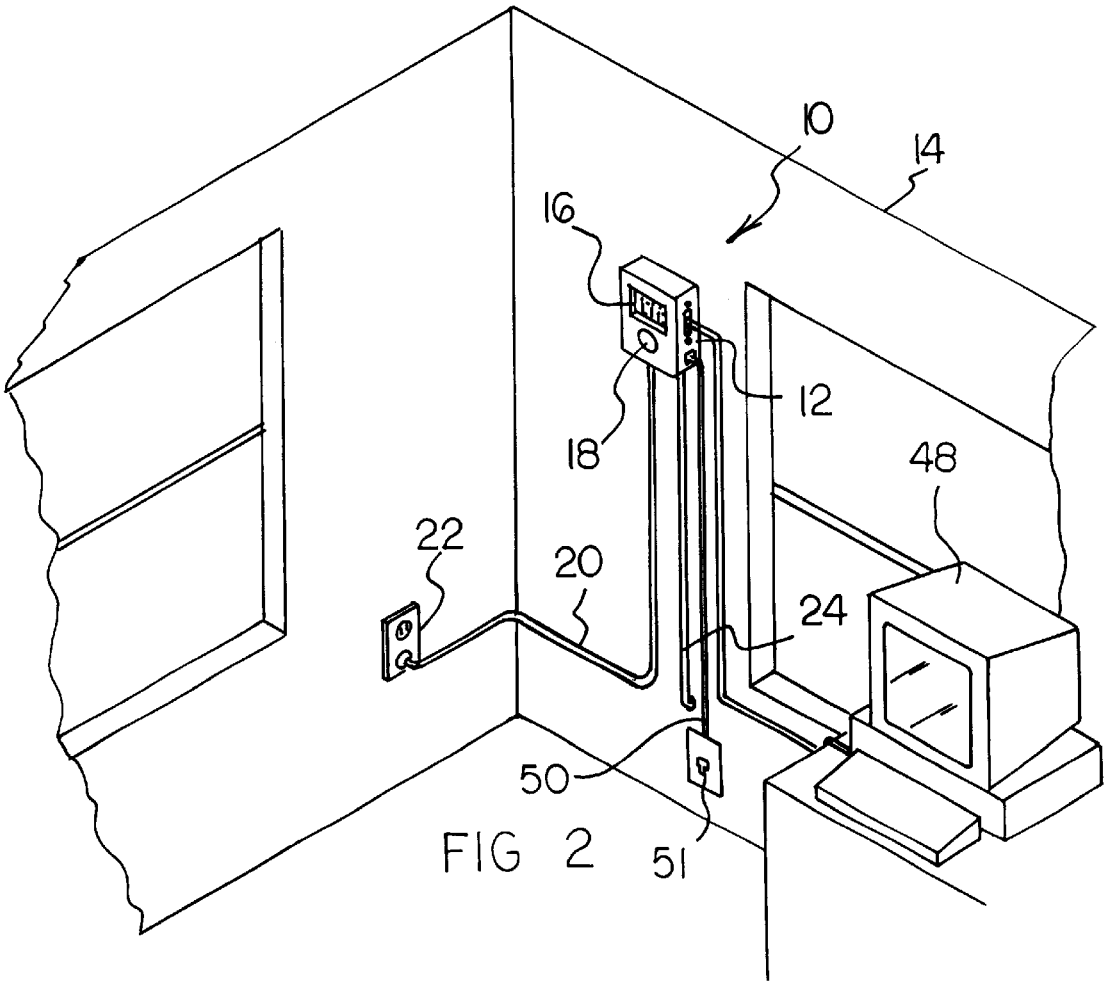
FIG. 2 is a perspective view of the apparatus shown in FIG. 1, but taken from interior of the house.
Figure 3:
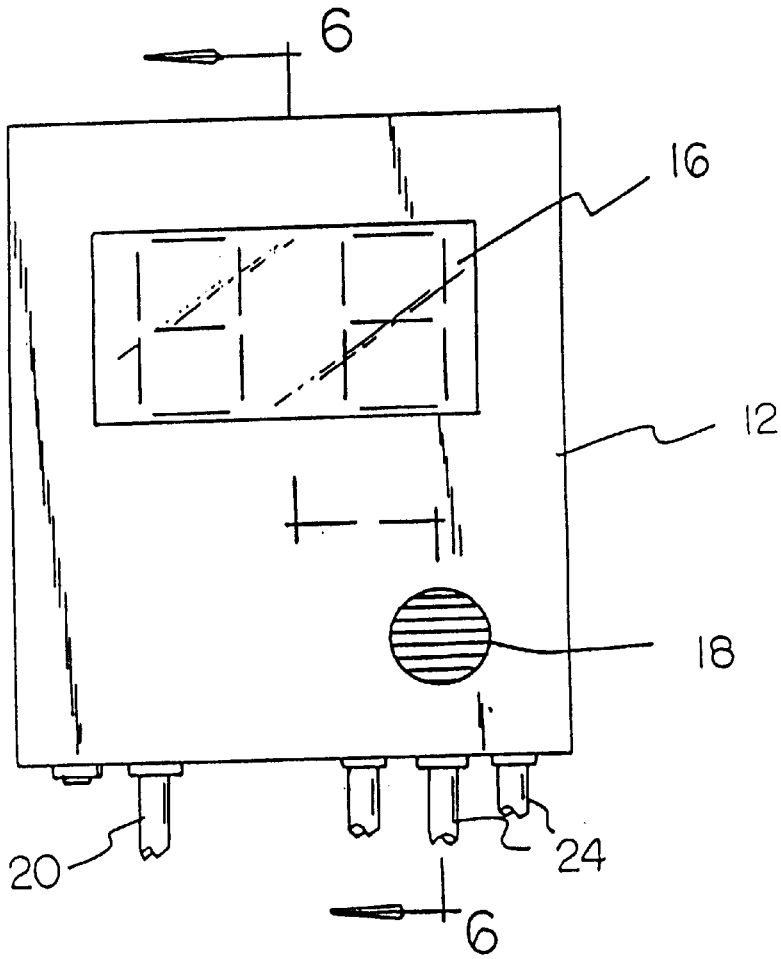
FIG. 3 is a front elevational view of the control box shown in FIG. 2.
Figure 4:
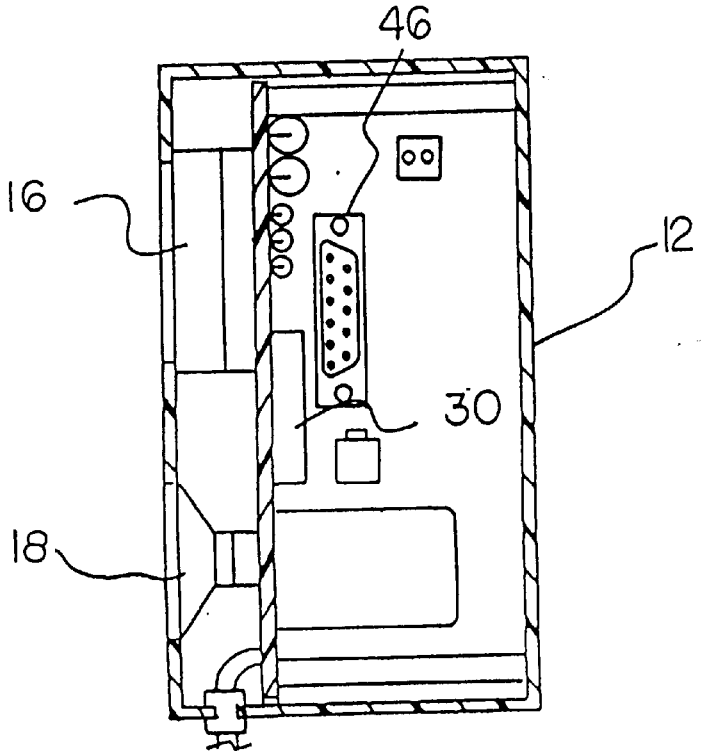
FIG. 4 is a cross sectional view taken along line 6—6 of FIG. 3.

With reference now to the drawings, and in particular to FIG. 1 thereof, the preferred embodiment of the new and improved electrical system embodying the principles and concepts of the present invention and generally designated by the reference numeral 10 will be described.

More specifically, the central component of the system is a control box 12. Such control box is for operating the system in an intended manner. It is preferably positioned within a house 14 of the user.

A digital light emitting diode display 16 is mounted to the control box. The display indicates a numerical value indicative of a sensed water pressure and a rate of flow of water.

Also a buzzer 18 is mounted in the control box. It functions to generate an audible signal upon the pressure flow or liquid bridging being identified outside of an acceptable range. Ideally, a remote security alarm service is connected with the buzzer. As such, the present invention may be monitored from afar. The remote security alarm is preferably connected via a phone line and is adapted to notify authorities upon the pressure being identified as being outside an acceptable range of pressures.

Extending downwardly form the control box is a first electrical line 20. Such electrical lines extends from the control box to a source of potential 22 within the house. The source of potential ideally comprises of a standard AC source in combination with a DC battery backup.

Next provided is a plurality of second electrical lines 24 from the control box to a plurality of water lines 26 for the house to sensed for changes and pressure.

Next provided is a third electrical line 50 from the control box to a telephone line.

Another electrical circuit 52 within the control box allowing the system to accept both AC and DC power. This outside transformer power supply, A/C to D/C, may be used to reduce the cost of the overall system.

Figure 5:
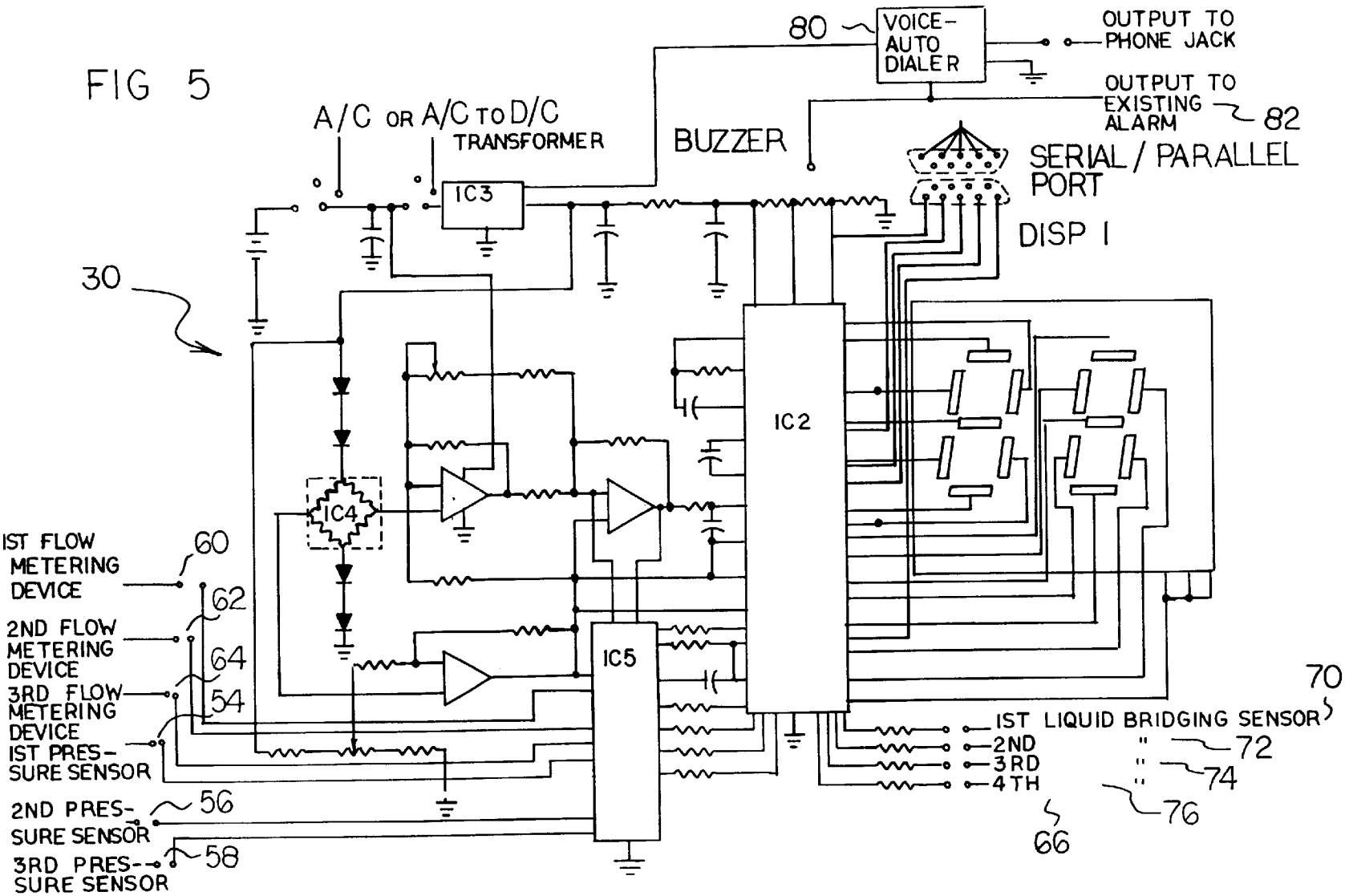
FIG. 5 is an electrical schematic of the control apparatus employed in the device of the prior Figures.

A plurality of pressure sensors 28 are coupled with respect to the second electrical lines to determine the pressure within the water line. These pressure sensors are also couple the display to indicate such determined pressure. FIG. 5 show three pressure metering devices including a first pressure metering device 54 in a first location, a second pressure metering device 56 in a second location and a third pressure metering device 58 in a third location. However the present invention is not limited by this number.

Further provided is a plurality of flow metering devices 40. These flow metering devices are coupled with respect to the second electrical lines. Their function is to determine the rate of flow of the water within the water line and to allow the display to indicate such determined rate of flow of the water. FIG. 5 shows three such flow metering devices including a first flow metering device 60 in the first location, a second flow metering device 62 in the second location and a third flow metering device 64 in the third location. However the present invention is not limited to this number.

Also provided are a plurality of liquid bridging sensors 66.

FIG. 5 show four such devices including a first liquid bridging sensor 70 in a first site, a second liquid bridging sensor 72 in a second site, a third liquid bridging sensor 74 in a third site and fourth bridging sensor 76 in a fourth site. All the liquid bridging sensor are mounted to the second electrical lines to detect leak outside of the pipes. However the present invention is not limited to this number.

Next included is a valve 30 actuated by electromechanical means. The valve is located within the water line at the first location and mounted thereto adjacent to the pressure sensor and flow sensor in a fashion similar to that of an existing main control valve. The valve is adapted to shut off the flow of water automatically upon the pressure flow or liquid bridging being outside of the acceptable range for a predetermined amount of time. The valve is further adapted to shut off the flow of water manually from the control box or other source at the discretion of a user upon the inspection of the display on the control box or remote location.

It should be noted that the valve is adapted to delay the shutting off of the flow of water until after a predetermined amount of time. Such time preferably comprises a period between at least 8 seconds in duration is necessary before the valve is closed. As such, normal operation of ice makers, toilets, and other water consuming devices within a household does not effect inadvertent closure of the valve.

A voice-auto dialer 80 is included in the control box and coupled to the third electrical allowing data from the system to be transferred via the telephone line. The voice autodialer may be incorporated to notify the user or authorities upon emergency water shut-off and the time thereof, via phone jack.

An existing alarm system 82 is coupled to the system to notify users and authorities.

An electrical circuit included in the control box includes a port 46 for allowing coupling with a conventional central computer 48.

Also provided is computing software adapted to be loaded on the central computer. This computing software allows the storing of the rate of flow of water and further calculating the amount of water consumed over a predetermined amount of time and the price of water consumed.

Further provided is an internet program loaded on to the central computer adapted to notify the user and authorities upon emergency shut-off and status of the water lines including the pressure and flow rate.

Lastly provided is control software loaded on the computer to program and is adapted to shut-off the water supply utilizing the central computer or a remote source via the internet.

Multiple pressure sensors, flow sensors and liquid bridging sensors may be connected to the control box to form a safety network to detect leaks, outside or inside of a building on any water supply pipe in any are inside or outside of the building.

The user may be able to program and shut-off the water supply via computer software program from the main or remote source.

Also, optionally, the computer software may interface with the main control box to detect a leak and utilize an existing internet software program to notify the user or authorities upon emergency water shut off the time thereof.

Also, unillustrated switches may be utilized to program the values, high or low, of the pressure or flow of water so the user can predetermine the range of an acceptable water shut off time.

This allows leaky faucets, toilets and appliances to still operate without premature water shut-off.

Also unillustrated switches may be immediately utilized to program the on or off flow of water within a day, week or month if needed to allow for maintenance inside or outside of the building when the user is home or away.

The present invention can be configured in various models and kits. For example a first model would comprise:

1. Control Box
a. User programmable
b. Automatic or manual water shut-off
c. Time delay
d. HI-LOW pressure shut-off
e. FLOW rate shut-off
f. Data display-time, day, week, month
g. Data logging-time, day, week, month
h. Automatic water shut(off and on)- with user programming time, day, week month
2. Only one Pressure Sensor
3. Only one Flow Sensor
4. Only one Shut-Off Valve
5. Alarm Hook-up
6. A/C to D/C low voltage DC transformer
7. Battery Back-up
8. Without computer interface or software A Second Model comprising:

1. Control Box
a. User programmable
b. Automatic or manual water shut-off
c. Time delay d. HI-LOW pressure shut-off
e. FLOW rate shut-off
f. Data display-time, day, week, month
g. Data logging-time, day, week, month
h. Automatic water shut(off and on)- with user programming time, day, week month
2. With one or more Liquid Bridging Sensors
3. With one or more Pressure Sensor
4. With one or more Flow Sensor
5. With one or more Shut-Off Valve
6. Alarm Hook-up
7. A/C to D/C low voltage DC transformer
8. Battery Back-up
9. Without computer interface or software A Third Model comprising:

1. Control Box
a. User programmable
b. Automatic or manual water shut-off
c. Time delay
d. HI-LOW pressure shut-off
e. FLOW rate shut-off
f. Data display-time, day, week, month
g. Data logging-time, day, week, month
h. Automatic water shut(off and on)- with user programming time, day, week month
2. With one or more Liquid Bridging Sensors
3. With one or more Pressure Sensor
4. With one or more Flow Sensor
5. With one or more Shut-Off Valve
6. Alarm Hook-up
7. A/C to D/C low voltage DC transformer
8. Battery Back-up 9. Without computer interface or software
10. With computer interface, two way data transmission between computer and control box, software.

A Fourth Model comprises:

1. Control Box
a. User programmable
b. Automatic or manual water shut-off
c. Time delay
d. HI-LOW pressure shut-off
e. FLOW rate shut-off
f. Data display-time, day, week, month
g. Data logging-time, day, week, month
h. Automatic water shut(off and on)- with user programming time, day, week month
2. With one or more Liquid Bridging Sensors
3. With one or more Pressure Sensor
4. With one or more Flow Sensor
5. With one or more Shut-Off Valve
6. Alarm Hook-up
7. A/C to D/C low voltage DC transformer
8. Battery Back-up
9. Without computer interface or software
10. With computer interface, two way data transmission between computer and control box, software
11. With program software that will interface user's internet software programs to allow user to be notified by e-mail when a leak has been detected and the water has been shut off.

A Fifth Model comprising:

1. Control Box
a. User programmable
b. Automatic or manual water shut-off
c. Time delay
d. HI-LOW pressure shut-off
e. FLOW rate shut-off
f. Data display-time, day, week, month
g. Data logging-time, day, week, month
h. Automatic water shut(off and on)- with user programming time, day, week month
2. With one or more Liquid Bridging Sensors
3. With one or more Pressure Sensor
4. With one or more Flow Sensor
5. With one or more Shut-Off Valve
6. Alarm Hook-up
7. A/C to D/C low voltage DC transformer
8. Battery Back-up
9. Without computer interface or software
10. With computer interface, two way data transmission between computer and control box, software
11. With program software that will interface user's internet software programs to allow user to be notified by e-mail when a leak has been detected and the water has been shut off.
12. With voice auto-dialer to allow user to program a telephone number and be notified via telephone by a pre-programmed voice message when a leak has been detected and the water has been shut off.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved electronic system for controlling and monitoring water lines, comprising, in combination:

a control box for the system positionable within the house of a user;

a digital light emitting diode display mounted to the control box to indicate a numerical value indicative of a sensed water pressure and a rate of flow of water;

a buzzer mounted in the control box to generate an audible signal upon the pressure flow or liquid bridging being identified outside of an acceptable range;

a first electrical line from the control box to a source of potential within the house;

a plurality of second electrical lines from the control box to a plurality of water lines for the house;

a third electrical line from the control box to a telephone line;

an electrical circuit within the control box allowing the system to accept both AC and DC power;

a plurality of pressure sensors coupled with respect to the second electrical lines to determine the pressure within the water line and to allow the display to indicate such determined pressure including a first pressure metering device in a first location, a second pressure metering device in a second location and a third pressure sensor in a third location;

a plurality of flow metering device coupled with respect to the second electrical lines to determine the rate of flow of the water within the water line and to allow the display to indicate such determined rate of flow of the water including a first flow metering device in the first location, a second flow metering device in the second location and a third flow metering device in the third location;

a plurality of liquid bridging sensors including a first liquid bridging sensor in a first site, a second liquid bridging sensor in a second site, a third liquid bridging sensor in a third site and fourth bridging sensor in a fourth site and all being mounted to the second electrical lines to detect leak outside of the pipes;

a valve actuated by electro-mechanical means, the valve located within the water line at the first location and mounted thereto adjacent to the pressure sensor and flow sensor in a fashion similar to that of an existing main control valve, the valve adapted to shut off the flow of water automatically upon the pressure flow or liquid bridging being outside of the high and low acceptable range for a predetermined amount of time, the valve adapted to shut off the flow of water manually from the control box at the discretion of a user upon the inspection of the display;

a voice-auto dialer in the control box coupled to the third electrical allowing data from the system to be transferred via a phone line;

an existing alarm system coupled to the system to notify users and authorities;

an electrical circuit for controlling the box including a port for allowing coupling with a conventional central computer computing software adapted to be loaded on the central computer allowing the storing of the rate of flow of water and further calculating the amount of water consumed over a predetermined amount of time and the price of water consumed;

an internet program loaded on to the central computer adapted to notify the user and authorities upon emergency shut-off and provide the pressure and flow rate of the water lines; and control software loaded on the computer to program and shut-off the water supply utilizing the central computer or a remote source via the internet.

2. A electronic system for comprising:

a control box for the system positionable within the house of a user;

a first electrical line from the control box to a source of potential within the house;

a plurality of second electrical lines from the control box to a plurality of water lines for the house;

a third electrical line from the control box to a telephone line;

a plurality of pressure sensors coupled with respect to the second electrical lines to determine the pressure within the water line and to allow the display to indicate such determined pressure;

a plurality of flow metering device coupled with respect to the second electrical lines to determine the rate of flow of the water within the water line and to allow the display to indicate such determined rate of flow of the water;

a plurality of liquid bridging sensors including a first liquid bridging sensor in a first site, a second liquid bridging sensor in a second site, a third liquid bridging sensor in a third site and fourth bridging sensor in a fourth site;

a valve actuated by electro-mechanical means, the valve located within the water line;

a voice-auto dialer in the control box coupled to the third electrical allowing data from the system to be transferred via a phone line;

an electrical circuit for controlling the box including a port for allowing coupling with a conventional central computer computing software adapted to be loaded on the central computer allowing the storing of the rate of flow of water;

an internet program loaded on to the central computer adapted to notify the user and authorities upon emergency shut-off and provide the pressure and flow rate of the water lines; and control software loaded on the computer to program and shut-off the water supply.

3. A new and improved electronic system as set forth in claim 2 and further including a digital light emitting diode display mounted to the control box to indicate a numerical value indicative of a sensed water pressure and a rate of flow of water.

4. A new and improved electronic system as set forth in claim 3 and further including a buzzer mounted in the box to generate an audible signal upon the pressure flow or liquid bridging being identified outside of an acceptable range.

5. A new and improved electronic system as set forth in claim 4 and further including an electrical circuit within the control box allowing the system to accept both AC and DC power.

6. A new and improved electronic system as set forth in claim 5 and further including an existing alarm system coupled to the system to notify users and authorities.

7. A new and improved electronic system as set forth in claim 1 and further including switches to immediately program the on or off flow of water for an extended period of time within a day, week or month, if needed to allow for maintenance inside or outside of the building when the user is home or away.

* * * * *